US005349914A

United States Patent [19]

Lapo et al.

[11] Patent Number: 5,349,914

[45] Date of Patent: Sep. 27, 1994

[54] LEAKPROOF OIL SUPER-TANKER

[76] Inventors: Robert M. Lapo, P.O. Box 3732, Wenatchee, Wash. 98807; George Spector, 233 Broadway Rm. 702, New York, N.Y. 10279

[21] Appl. No.: 84,162

[22] Filed: Jun. 30, 1993

[51] Int. Cl.[5] ..... B63B 25/12

[52] U.S. Cl. ..... 114/74 R; 220/461

[58] Field of Search ..... 114/74 R, 74 A, 74 T; 220/461, 470

[56] References Cited

U.S. PATENT DOCUMENTS

| | | | |
|---|---|---|---|
| 2,991,906 | 7/1961 | Eligoulachvili | 114/74 R |
| 3,859,944 | 1/1975 | Warner | 114/74 R |
| 4,409,919 | 10/1983 | Strain | 114/74 R |

*Primary Examiner*—Sherman Basinger

[57] ABSTRACT

A device is provided for impeding the spillage of a liquid cargo from a damaged hull of a water traveling vessel, which consists of a protective layer placed against an inner surface of the hull and a flexible inner placed between the protective layer and the liquid cargo, so that if the hull is punctured, the protective layer will hold the flexible liner and the liquid cargo in place.

2 Claims, 1 Drawing Sheet

LEAKPROOF OIL SUPER-TANKER

BACKGROUND OF THE INVENTION

The instant invention relates generally to cargo ship buffers and more specifically it relates to a device for impeding the spillage of a liquid cargo from a damaged hull of a water traveling vessel, which provides a protective layer and flexible liner within the hull, so that if punctured the protective layer will hold the flexible liner and the liquid cargo in place.

There are available various conventional cargo ship buffers which do not provide the novel improvements of the invention herein disclosed.

SUMMARY OF THE INVENTION

A primary object of the present invention is to provide a device for impeding the spillage of a liquid cargo from a damaged hull of a water traveling vessel that will overcome the shortcomings of the prior art devices.

Another object is to provide a device for impeding the spillage of a liquid cargo from a damaged hull of a water traveling vessel by utilizing a mesh screen against the inside of the hull and a flexible liner between the mesh screen and the liquid cargo.

An additional object is to provide a device for impeding the spillage of a liquid cargo from a damaged hull of a water traveling vessel in which movable perforated flexible plates are substituted for the mesh screen within the hull, to better protect the flexible liner when the hull is distorted or ruptured by impact with an external object.

A further object is to provide a device for impeding the spillage of a liquid cargo from a damaged hull of a water traveling vessel that is simple and easy to use.

A still further object is to provide a device for impeding the spillage of a liquid cargo from a damaged hull of a water traveling vessel that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
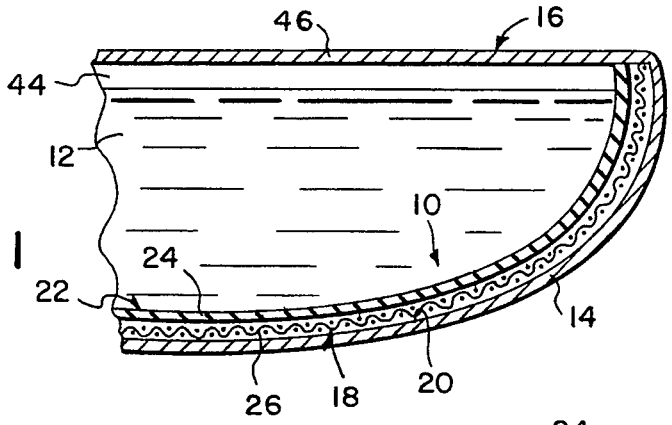
FIG. 1 is a diagrammatic cross sectional view of a hull of a water traveling vessel with the instant invention installed therein to impede the spillage of liquid cargo.

Turning now descriptively to the drawings, in which similar reference characters denote similar elements throughout the several views, FIG. 1 illustrates a device 10 for impeding the spillage of a liquid cargo 12 from a damaged hull 14 of a water traveling vessel 16, which consists of a protective layer 18 placed against an inner surface 20 of the hull 14. A flexible liner 22 is placed between the protective layer 18 and the liquid cargo 12. If the hull 14 is punctured, the protective layer 18 will hold the flexible liner 22 and the liquid cargo 12 in place.

Figure 2:
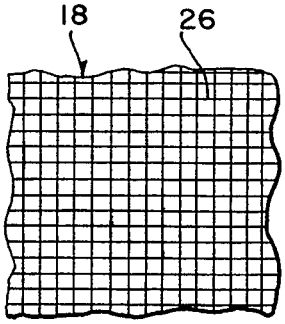
FIG. 2 is a top plan view of a portion of the mesh screen.
Figure 3:
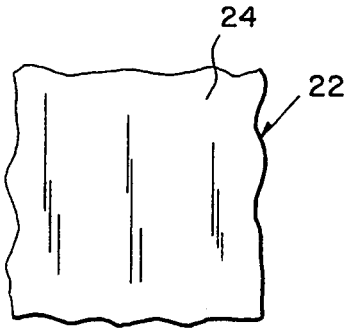
FIG. 3 is a top plan view of a portion of the flexible liner.

The flexible liner 22, as best seen in FIG. 3, is fabricated out of rubber 24, which is resistant to the liquid cargo 12. The protective layer 18, as best seen in FIG. 2, is a mesh screen 26, fabricated out of light weight steel/aluminum and nylon.

Figure 4:
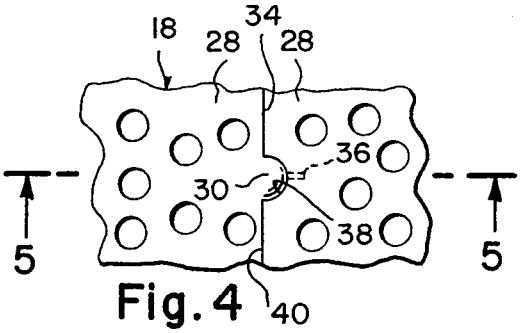
FIG. 4 is a top plan view of a modification showing perforated flexible plates to replace the mesh screen within the hull.
Figure 5:
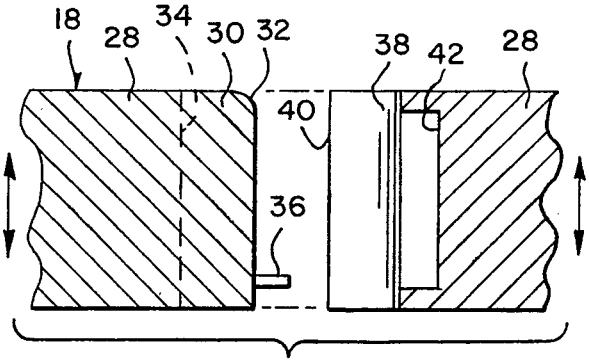
FIG. 5 is an enlarged exploded cross sectional view taken along line 5—5 in FIG. 4, showing a male member with a flexible pin on one plate and a female socket with a slot on the other plate in greater detail.
Figure 6:
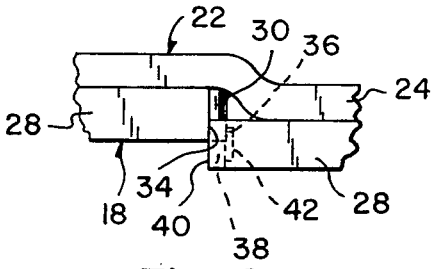
FIG. 6 is a side view of the plates offset to conform to the hull shape and when the hull is distorted by impact with external objects.

As shown in FIGS. 4, 5 and 6, the protective layer 18 is a plurality of interconnecting movable perforated flexible plates 28. Each plate 28 includes at least one male member 30, having a round top corner 32 on one side 34 of the plate 28 from top to bottom. A flexible pin 36 extends outwardly form near the bottom of the male member 30. At least one female socket 38 is on an opposite side 40 of the plate 28 from top to bottom and has a slot 42 extending inwardly.

The at least one male member 30 can mate with the at least one female socket 38 on another plate 28, allowing the flexible pin 36 to enter the slot 42. The plate 28 can ride up and down with respect to each other, to conform to the shape of the hull 14 and when the hull 14 is distorted by impact with external objects.

Typically the water traveling vessel 16 can be an oil tanker with a large compartment 44 below a deck 46 within the hull 14. The liquid cargo 12 can be oil, placed within the large compartment 44. The device 10 is located between the oil and the hull 14, thereby preventing the oil from exiting a damaged hull 14, to pollute the water about the oil tanker.

OPERATION OF THE INVENTION

To use the device 10 simply place the protective layer 18 into the hull 14 against the inner surface 20. The flexible liner 22 is then placed against the protective layer 18. The liquid cargo 12 is filled into the large compartment 44 below the deck 46. If the hull 14 is damaged, so that a hole is made therein, the liquid cargo 12 will not leak therefrom, since the protective layer 18 will hold back the flexible liner 22.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A device for impeding the spillage of a liquid cargo from a damaged hull of a water traveling vessel which comprises:

a) a protective layer placed against an inner surface of the hull;

b) a flexible liner placed between said protective layer and the liquid cargo so that if the hull is punctured, said protective layer will hold said flexible liner and the liquid cargo in place within the hull; wherein said flexible liner is fabricated out of rubber which is resistant to the liquid cargo; wherein said protective layer is a plurality of interconnecting movable perforated flexible plates; wherein each said plate includes:

c) at least one male member having a round top corner on one side of said plate from top to bottom;

d) a flexible pin extending outwardly from near the bottom of said male member; and e) at least one female socket on an opposite side of said plate from top to bottom and having a slot extending inwardly so that at least one male member can mate with said at least one female socket on another said plate, allowing said flexible pin to enter said slot, thereby said plates can ride up and down with respect to each other to conform to the shape of the hull and when the hull is distorted by impact with external objects.

2. A device for impeding the spillage of a liquid cargo from a damaged hull of a water traveling vessel which comprises:

a) a protective layer placed against an inner surface of the hull;

b) a flexible liner placed between said protective layer and the liquid cargo so that if the hull is punctured, said protective layer will hold said flexible liner and the liquid cargo in place within the hull; wherein said protective layer is a plurality of interconnecting movable perforated flexible plates; wherein each said plate includes:

c) at least one male member having a round top corner on one side of said plate from top to bottom;

d) a flexible pin extending outwardly from near the bottom of said male member; and e) at least one female socket on an opposite side of said plate from top to bottom and having a slot extending inwardly so that at least one male member can mate with said at least one female socket on another plate, allowing said flexible pin to enter said slot, thereby said plates can ride up and down with respect to each other to conform to the shape of the hull and when the hull is distorted by impact with external objects.

* * * * *